United States Patent [19]

Reed et al.

[11] 4,039,276

[45] Aug. 2, 1977

[54] NOISE AND SMOKE RETARDANT FLARE

[75] Inventors: Robert D. Reed; Robert E. Schwartz, both of Tulsa, Okla.

[73] Assignee: John Zink Company, Tulsa, Okla.

[21] Appl. No.: 665,863

[22] Filed: Mar. 11, 1976

[51] Int. Cl.[2] ..... F23D 13/20

[52] U.S. Cl. ..... 431/202; 23/277 C; 431/114

[58] Field of Search ..... 431/5, 202, 114, 278, 431/285, 4, 190; 23/277 C; 98/59, 60; 110/184

[56] References Cited

U.S. PATENT DOCUMENTS

| | | | |
|---|---|---|---|
| 2,802,521 | 8/1957 | Campbell et al. | 431/202 X |
| 3,801,261 | 4/1974 | Reed et al. | 431/202 |
| 3,932,111 | 1/1976 | Likmes et al. | 431/202 |

*Primary Examiner*—Edward G. Favors

*Attorney, Agent, or Firm*—Head, Johnson & Chafin

[57] ABSTRACT

A flare for the burning of waste gases which is designed to provide a minimum of noise and smoke pollution, comprising a vertical stack having a shroud in the form of a cylinder surrounding, and spaced outwardly from, the top portion of the stack, and extending above the top of the stack. The space between the shroud and the stack is closed off by an annular plate which serves to support the shroud from the stack. At the top of the shroud is a steam manifold which carries a plurality of steam nozzles spaced angularly around the inner face of the manifold, so as to direct high velocity steam jets inwardly and upwardly toward the axis of the stack. The nozzles are placed on the inner face of the manifold so as to be substantially below and inside of the outer contour of the manifold and the shroud. The outer circumference of the shroud near its bottom end is perforated with a plurality of circumferentially spaced openings through which air can pass to the annular space between the shroud and the stack. The upwardly moving air mixes with the gas flowing up the stack, and burns in the wind-protected zone above the top of the stack, and below the top of the steam manifold. Above the top of the steam manifold the jets of steam driving into the rising column of burning gas carry in combustion air and throughly agitate and mix the combustion air, the steam, and the burning gas.

9 Claims, 6 Drawing Figures

NOISE AND SMOKE RETARDANT FLARE

CROSS-REFERENCE TO RELATED APPLICATION

This Application is related to copending application Ser. No. 665,862 filed 3/11/76 in the name of Dr. Robert D. Reed, entitled: Noise Retardant tandem Orifice for High Pressure Gases.

BACKGROUND OF THE INVENTION

This invention lies in the field of smokeless, noise suppressed combustion of waste gases.

More particularly, this invention lies in the field of the flaring of waste gases in such a manner as to provide smokeless combustion without excessive noise.

In the art of smokeless flaring of smoked-prone gases, it is common practice to inject steam into the burning zone downstream of the flare to alter the chemistry of burning, in a well known manner, to avoid smoke emission from the burning gases. Because the steam is generally delivered to the combustion zone, at a high pressure, typically 100 psi gauge, the steam injection is productive of excessive noise for several reasons. The most important reason is that with unaltered 100 psig steam (114.7 psia), inflow as from, or through, a single orifice, the steam flow creates shock waves as it emerges to atmospheric pressure at the mouths of the orifices. A second reason for noise generation in excess of specified limits, is that the orifices from which the steam is flowing are generally completely open and exposed, permitting noise radiation to adjacent areas at ground level and also areas remote front the stack.

It is therefore a primary object of this invention to provide a flare system for combustion of waste gases in which high pressure steam is used to promote smokeless combustion, but with a minimum of noise pollution.

It is a further object of this invention to provide a flare for the burning of waste gases in which a protected burning zone free of wind chilling, at the discharge end of the flare, is provided so as to promote stable burning and therefore minimum smoke production.

It is a further object of this invention to provide a type of steam nozzle so that the steam injected into the rising column of burning gas, although at high pressure in the manifold, will not generate noise. It is preferable that steam injection from adjacent nozzles be at varying angles with reference to the horizontal, but not so demanded.

It is a still further object of this invention to provide a type of construction for the stack such that a shroud is provided around the top of the stack which shields the surrounding area from noise generated by the steam jets.

SUMMARY OF THE INVENTION

These and other objects are realized and the limitations of the prior art are overcome in this invention by providing a stack which has a shroud surrounding the discharge end of the stack. The shroud is of larger diameter than, and rises above the top of, the stack and carried at its top edge a steam manifold. The steam nozzles which are circumferentially spaced are on the inner face of the manifold so that the steam jets which emerge from the nozzles are substantially inside of a wall comprised of the manifold and the shroud, which prevents noise generated by the steam jets from spreading downwardly and outwardly to ground level.

The shroud is closed off at the bottom to provide an annular space between the shroud and the stack. There are a plurality of circumferentially spaced openings at the bottom of the shroud for the admission of wind driven air, or induced air, that flows through the perforations and up through the annular space inside of the shroud, to a burning region above the top of the stack, and below the top of the steam manifold. Ignition and combustion of the emerging stack gases can be carried on in this wind-shielded space in a stable quiet manner, free of interference and chilling by wind. A specially designed flame-retention gas flow nozzle is preferred, but not required at the discharge termination of the flare stack, which is protected from wind effect. The mixture of combustion air and burning gas in the burning zone above stack, rises in a column and is subjected to the inwardly and upwardly flowing high velocity jets of steam. These high velocity jets induce air flow with them, into the rising column, thoroughly mixing the air and steam with the burning gases, so as to promote chemical action of the steam, in a high temperature environment, for the complete combustion of carbon.

The design of the steam nozzles is novel, in that they comprise, in a cylindrical metal rod, two axial orifices in series, a first small diameter orifice which leads into a large diameter orifice, from which the steam flows into the atmosphere. The length of each of the two orifices in the nozzle is greater than their respective diameters.

With this multiple orifice design, an absolute steam pressure greater than twice atmospheric pressure, will provide substantially sonic steam flow at the outlet of the nozzle, without the production of a high noise level, which might be caused by the presence of shock waves generated in the conventional type of single orifice.

BRIEF DESCRIPTION OF THE DRAWINGS

These and other objects and advantages of this invention, and a better understanding of the principles and details of the invention will be evident from the following description, taken in conjunction with the appended drawings, in which.

DESCRIPTION OF THE PREFERRED EMBODIMENT

Figure 1:
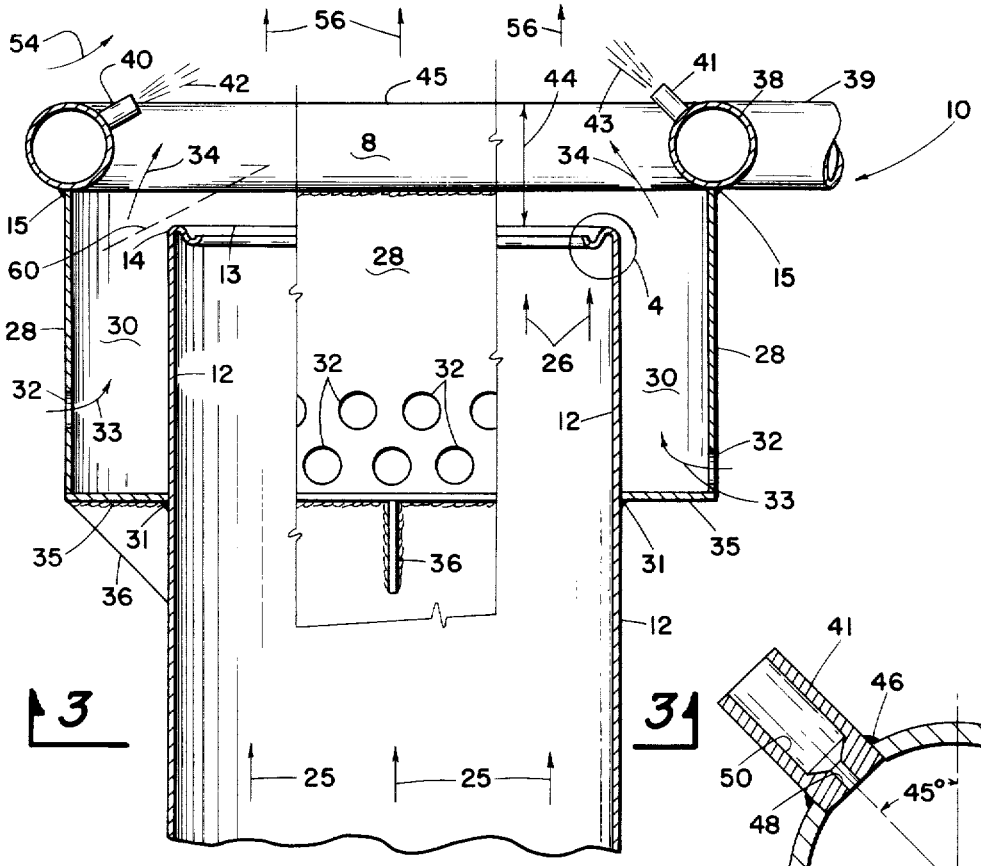
FIG. 1 is a vertical cross-sectional through the flare stack of this invention.

Referring now to the drawings, and in particular to FIG. 1, there is designated as 10, in vertical cross-section, the upper portion of the flare stack of this invention.

A cylindrical steel structure 12 is supported vertically and carries the upward flow of waste fuel gases, which flow in accordance with arrow 25. Surrounding the top end of the stack is a shroud 28, which is of larger diameter than the stack 12, and which extends above the top of the stack 12. The shroud carries at its top edge a circular steam manifold 38, which is supplied with steam through pipe 39. The annular space 30 between the stack 12 and shroud 28 is closed by an annular plate 35 which is welded at junction 31 in a conventional manner. The shroud is further supported by means of triangular gusset plates 36 as shown, which can be attached by welding, as is well known in the art.

There is a selected dimension 44 between the top edge 13 of the stack 12, and the top 45 of the manifold 38. This provides a selected burning zone which is shielded from transverse wind, which otherwise would have a chilling effect on the ignition and combustion of the gases.

Figure 4:
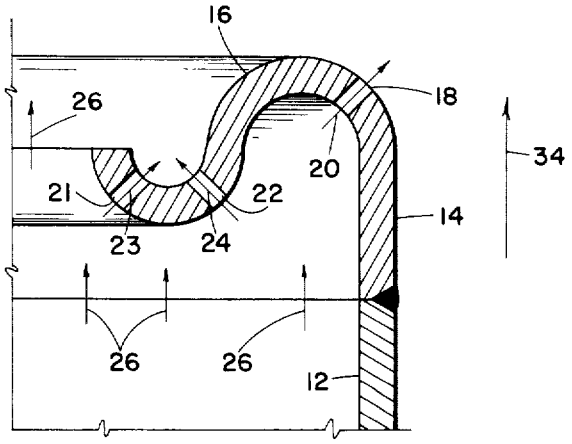
FIG. 4 illustates a detail of construction of the top edge of the flare stack.

The top of the stack 12 has a detail, shown in larger scale in FIG. 4, which comprises an inner flange 14, 16, in the form of a double reverse bend. There are a plurality of orifices 18, 22 and 21 through which rising gas 26 can, in accordance with arrows 20, 22, 23, flow through the orifices into the combustion zone above the top 13 of the stack 12.

Gas flowing through the orifices 18, for example, in accordance with arrow 20 will provide outward jets of gas which mix with the rising flow of air 34 surrounding the top of the stack, which is flowing through the annular space 30 between the stack 12 and the shroud 28. This rising flow of air 34 is provided by a plurality of openings 32 arranged near the base of the shroud. Wind driven air, through the openings 32, can flow up the annular space 30 in accordance with arrows 33 and 34. In the absence of wind, there will be suction driven air entering through the openings 30, due to the induction effect of the steam nozzles 40 and 41, creating a reduced pressure inside of the manifold and below the top level 45. The combustion air 34 mixing with the gas 26 in the quiet atmosphere of zone 8 below level 45, protected from transverse winds, provides a stable ignition and combustion volume so that the gas is thoroughly mixed with the air and at a combustion temperature sufficient to thoroughly ignite the gas and provide a stable flame.

As this column of burning gas rises above the level 45, the steam jets 42 and 43 from the nozzles 40 and 41 induce additional air injection 54, with the steam, into the rising column of burning gas, in accordance with arrows 56. The high velocity steam jets provide thorough mixing between the combustion air 54, the steam 42, 43 and the burning gas 56.

Figure 2:
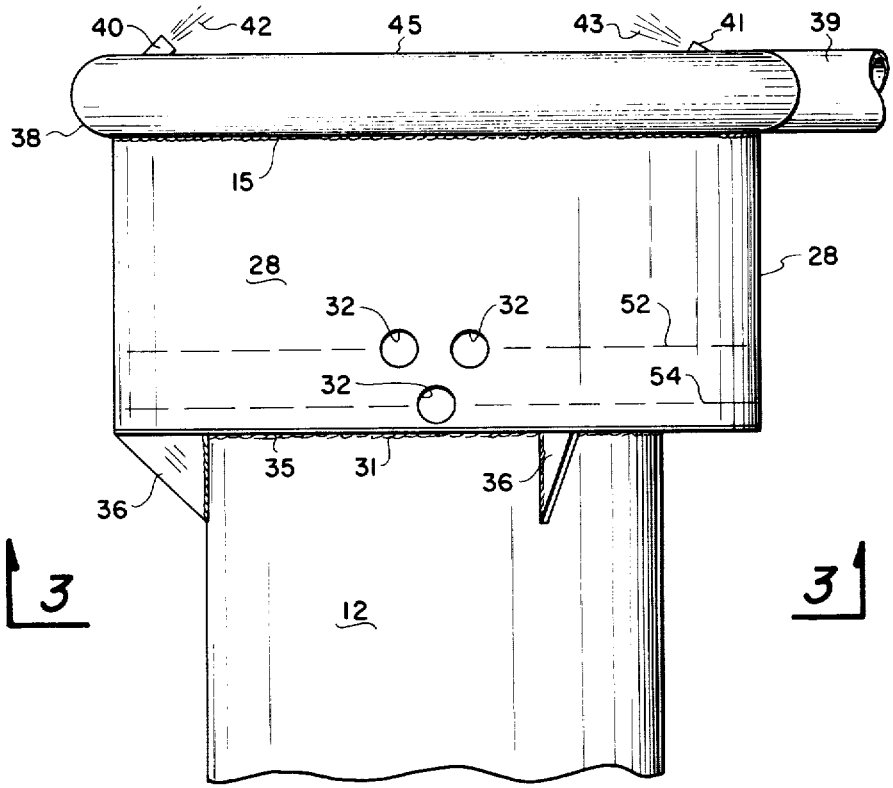
FIG. 2 is a vertical elevation view of the upper portion of the stack and shroud.

FIG. 2 shows an external view of the top of the stack, including the stack 12, the shroud 28 supported by plate 35 and gussets 36, and the steam manifold 38 mounted to the top of the shroud.

Figure 3:
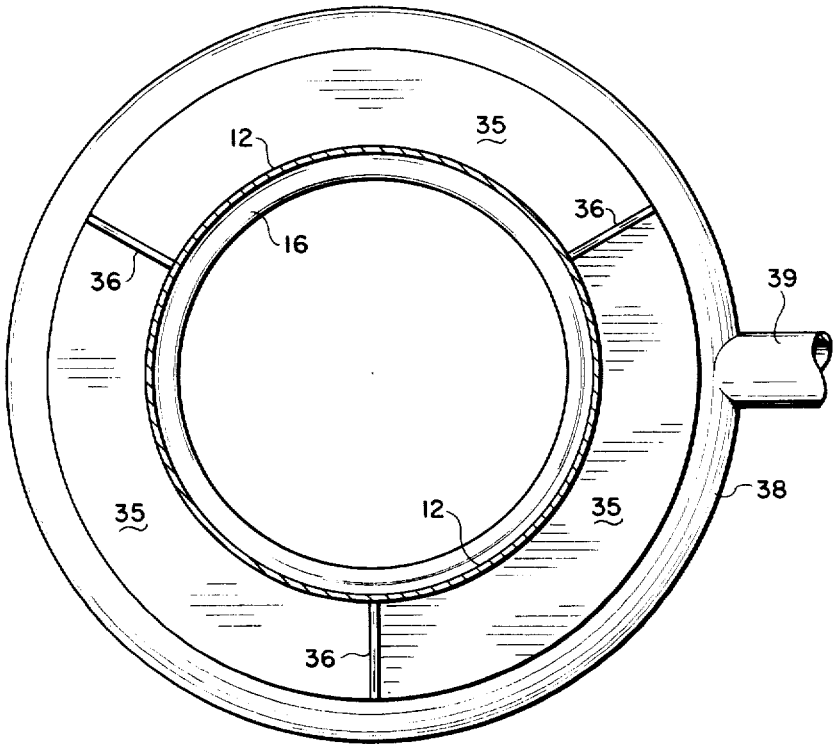
FIG. 3 is a cross-sectional view along the plane 3—3 of FIG. 2.

FIG. 3 shows a view of FIG. 2 taken along the plane 3—3 which again shows the stack cylinder 12, the inner flange 16, the plate 35, the gussets 36, and the steam manifold 38.

In FIG. 2, only the tips 40 and 41 of the steam nozzles are shown to be above the level of the top edge 45 of the steam manifold, so that any noise generated at the nozzles is prevented by the steam manifold 38 and the shroud 28, from flowing downward and outward toward the ground surface in the vicinity of the stack.

Figure 5:
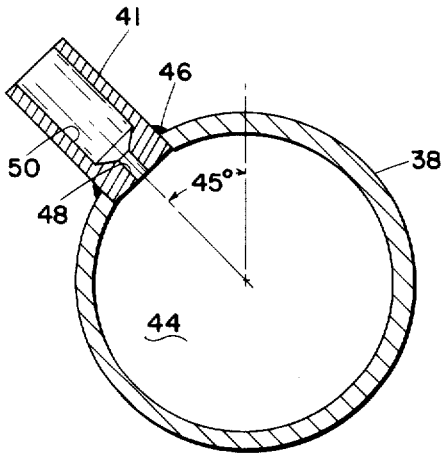
FIGS. 5 and 6 illustrate details of the steam nozzles.
Figure 6:
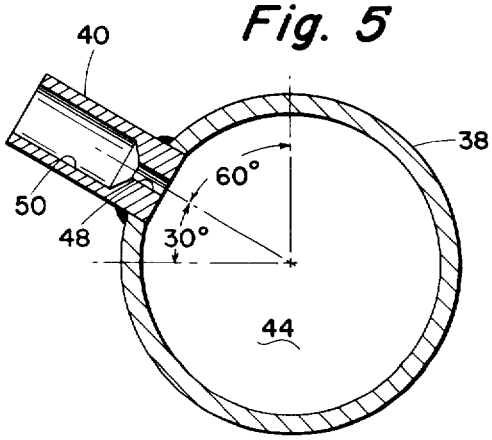

Referring now to FIG. 5 and 6, there are shown two views of the steam nozzles, one of them in FIG. 5 is set at an upward angle above the horizontal of 45° while the other in FIG. 6 is set at an angle 30° above the horizontal. The plurality of nozzles on the inner surface of the manifold 38 are equally spaced and there are equal numbers of the two types, of FIGS. 5 and 6. Alternate nozzles are set at the 30° angle, and the intermediate nozzles at 45°, so as to provide a better mixing of the steam and induced air into the rising column of burning gas.

Each of the nozzles comprises a steel cylinder 40, 41 that is welded 46 into the wall of the steam manifold 38. There is an entrance orifice 48 of a selected diameter, and length greater than its diameter. This entrance orifice opens into a second orifice 50 of large diameter, and length greater than its diameter. In general, the steam pressure in space 44 inside the manifold, will be of the order of 100 psi gauge, which is many times the atmospheric pressure at the outlet end of the nozzle. It is well known that when a gas issues from a high pressure through a single orifice, to a low pressure, where the absolute high pressure is greater than twice the absolute value of the outlet pressure, that excess pressure results in compression of the gas, and at the outlet of the single orifice, permits rapid expansion and generation of a shock wave, which creates an undue volume of noise. By the use of two or more orifices in series, of selected diameters, and lengths, then, when the pressure in the manifold is greater than twice the outlet pressure, the passage through the first orifice does not create shock waves since the gas is confined by the second orifice. Also, the pressure in the second orifice is greater than atmospheric pressure.

The series of two orifices is designed so that the pressure in the second orifice is substantially twice, in absolute pressure, the pressure at the outlet of the nozzle. Consequently, the output of the second orifice results in a slightly less than sonic velocity of steam, without the generation of shock wave noise.

SUMMARY OF THE INVENTION

In summary, what has been described in an improved flare stack for the combustion of waste gases, wherein a stable high temperature flame is provided by the addition of a shroud which surrounds and rises above the level of the top of the stack. Means are provided for entry of air into the annular space between the shroud and the stack, so that ignition and quiet combustion can take place in the burning zone between the top edge of the shack and the top edge of the shroud.

If steam is to be added into the burning gases to promote the complete combustion of carbon, this is provided from a steam manifold which surmounts the shroud, and adds additional depth to the quiet combustion zone, which is shielded from the chilling effect of transverse winds. Thus, a flame temperature can be provided which is high enough to utilize the steam injection, for the purpose of improved burning chemistry.

A plurality of steam jets are created by a plurality of nozzles mounted on the inner surface of the steam manifold, so that the steam jets are substantially hidden from the ground by the presence of the manifold and the shroud, so that whatever noise is generated can only move upwardly, and is shielded from the ground surface close to and at some distance from the flare stack.

Finally, the steam nozzles are designed with a plurality of orifices in series, starting with a small diameter orifice at the inlet end of the nozzle and enlarging into at least a second orifice larger than the first, such that the pressure drop between the steam in the manifold and the atmosphere outside the nozzle, drops in at least one step to an intermediate value in the second orifice, which is substantially twice in absolute value, the atmospheric pressure, and consequently provides near sonic steam velocity in the jet with a minimum of shock wave generated noise.

Indicated by the dashed line 60 in FIG. 1 is a conventional igniter flame, which is continuously maintained, and serves to ignite the gas 26 as it reaches the top of the stack and mixes with the primary combustion air 34.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A noise and smoke retardant flare for the combustion of waste fuel gases comprising:

a. a flare stack;

b. a shroud surrounding the discharge end of said stack, said shroud extending a selected distance beyond the discharge end of said stack, an annular plate closing off the annular space between said stack and said shroud, at the base of said shroud;

c. a plurality of openings through the wall of said shroud near its base for the entry of primary combustion air; and d. means to ignite said waste gas as it is discharged from said stack;

whereby a wind-protected combustion zone just beyond the discharge end of said stack is provided for the mixing of primary combustion air with said gas, and for its ignition and burning; and including a steam manifold supported at the discharge end of said shroud;

a plurality of steam nozzles sealably inserted into the inside surface of said manifold and circumferentially spaced;

whereby said nozzles are at a level substantially at, or below the discharge end of said manifold.

2. The flare as in claim 1 in which said nozzles are all set at the same angle to the horizontal.

3. The flare as in claim 2 in which said nozzles are inserted at at least two different angles to the horizontal, with adjacent nozzles at different angles.

4. The flare as in claim 3 in which there are two sets of nozzles and said angles are about 30° and 40° respectively.

5. The flare as in claim 1 in which each of said nozzles comprises;

a. a cylinder of suitable metal which is in sealed communication with the interior of said manifold;

b. a first axial orifice of selected first diameter and selected first length greater than said first diameter;

c. at least a second orifice coaxial with said first orifice, and contiguous therewith;

d. said at least second orifice having a second selected diameter and selected second length greater than said second diameter;

e. said second diameter greater than said first diameter.

6. The flare as in claim 1 in which the termination of said flare is cylindrical.

7. The flare as in claim 7 including a gas discharge device at the termination of said flare.

8. The flare as in claim 7 in which the gas discharge device comprises a bent over flange extending inwardly, and a plurality of orifices drilled through said bent over flange, arranged in at least one circular pattern.

9. The flare as in claim 8 in which said orifices in said at least one circular pattern are drilled outwardly at an angle in the range of 1° to 60° to the vertical.

* * * * *